United States Patent [19]

Hayes

[11] Patent Number: 4,891,845

[45] Date of Patent: Jan. 9, 1990

[54] BASEBALL GLOVES

[76] Inventor: Rufus Hayes, 18640 Griggs, Detroit, Mich. 48221

[21] Appl. No.: 158,647

[22] Filed: Feb. 22, 1988

[51] Int. Cl.[4] ..... A63B 71/14; A41D 13/10

[52] U.S. Cl. ..... 2/19; 2/161 A; 2/162

[58] Field of Search ..... 2/19, 20, 161 A, 162, 2/170

[56] References Cited

U.S. PATENT DOCUMENTS

| | | | |
|---|---|---|---|
| 811,389 | 1/1906 | Ferry | 2/19 |
| 1,602,027 | 10/1926 | Kennedy | 2/19 |
| 1,790,381 | 1/1931 | Keller | 2/20 X |
| 2,558,544 | 6/1951 | Delsalle | 2/19 |
| 3,994,024 | 11/1976 | Bates | 2/19 |
| 4,065,813 | 1/1978 | Hudson | 2/19 |
| 4,400,831 | 8/1983 | Rietz | 2/161 A |
| 4,411,024 | 10/1983 | Hayes | 2/161 A X |
| 4,502,688 | 3/1985 | Papp | 2/161 A X |
| 4,541,127 | 9/1985 | Gould | 2/19 |
| 4,630,318 | 12/1986 | Aoki | 2/161 R X |
| 4,651,345 | 3/1987 | Latina | 2/19 |

*Primary Examiner*—Werner H. Schroeder
*Assistant Examiner*—Sara M. Current
*Attorney, Agent, or Firm*—Irving M. Weiner; Pamela S. Burt; Joseph P. Carrier

[57] ABSTRACT

A support portion for a baseball glove, the support portion being attached to a back wall of the glove so as to extend a distance above and below the free lower edge of the front wall of the glove sufficient to cover a lower back portion of the user's hand, the back of the user's wrist, and a back portion of the user's forearm. The support portion includes a securing member adapted to wrap around a user's arm below the wrist. In use, the support portion serves the dual purposes of supporting the user's wrist against injurious bending and imparting a natural control and feel to the glove.

9 Claims, 2 Drawing Sheets

FIG 1
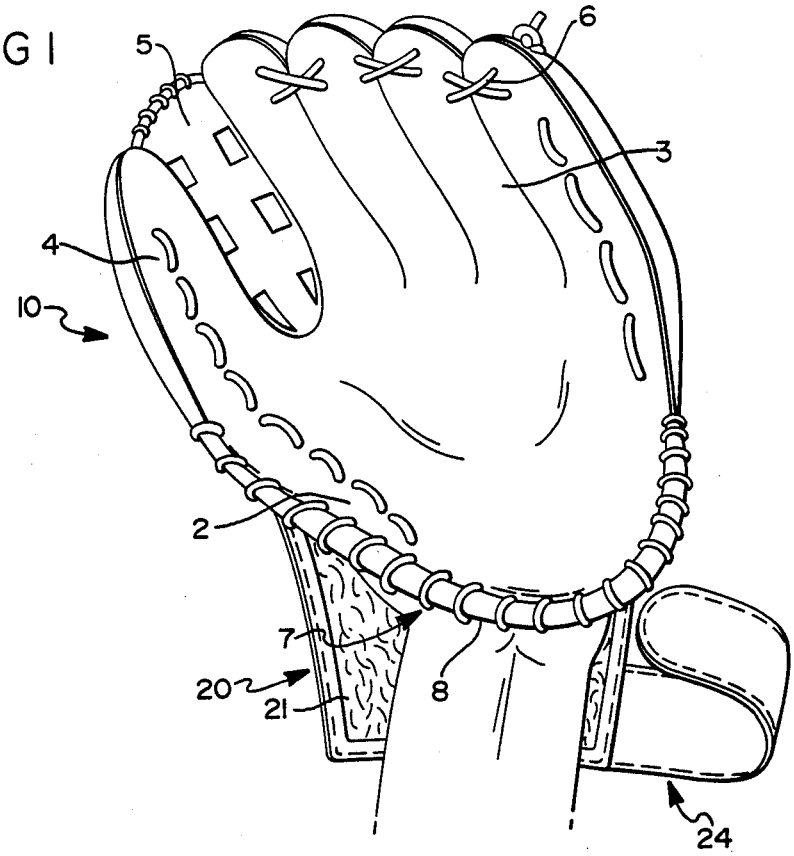
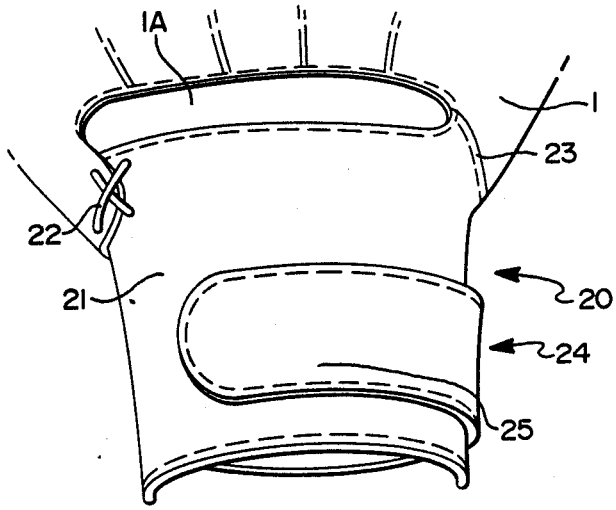
FIG 2

BASEBALL GLOVES

BACKGROUND OF THE INVENTION

1. Field of the Invention

The present invention relates generally to baseball gloves integrally provided with wrist support portions. More particularly, the invention relates to a support portion, attached to a conventional baseball glove, which not only supports the user's wrist, but also operatively cooperates with portions of the user's hand, wrist and forearm.

The terminology "baseball glove" as employed herein is intended to connote any of a variety of conventional baseball gloves or mitts comprising front and back walls joined together at upper and side portions thereof and defining at the lower portions thereof a hand insertion opening. Typically, such baseballs gloves have the front and back walls thereof joined together to define a thumb portion separate from a fingers portion, with an intermediate bridge or pocket portion connected between the thumb and fingers portions. Such baseball gloves or mitts typically conform to various professional baseball standards for size, pockets, adjustments and padding.

2. Description of Relevant Art

One of the major problems attendant conventional baseball gloves is the lack of support of one of the most vulnerable parts of the baseball player's body, his or her wrist. The wrist is particularly vulnerable due to the added weight of the baseball glove itself; and also due to the force of a ball caught in the glove, which is often sufficient tó cause the hand to bend backwards sharply at the wrist. When subjected to this sudden stress, the wrist is highly susceptible to spraining or other injury. At the same time, the player is quite likely to lose the ball he is attempting to catch.

Another problem attendant conventional baseball gloves relates to control. The unnatural heaviness and thick padding of the glove on the player's hand can often lead to an awkward unwieldiness of the gloved hand during play. There has thus developed a desideratum for a glove construction or attachment which is capable of making the rather heavy and sometimes unwieldy glove a more integral part of the user's catching arm, wrist and hand movements.

The present invention fulfills such disideratum by providing not only a firm support against backward bending of the hand about the user's wrist, but also enhanced control capabilities enabling the user's gloved hand to become a more natural part of the movements of the catching arm.

SUMMARY OF THE INVENTION

One of the many aspects of the baseball glove (or mitt) according to the invention is a much improved wrist strap construction that will enable the player to better handle the glove, and will also give the user of the glove better control. The glove will better protect the wrist of the player, and at the same time permit the glove to be flexed, so as not to unduly restrain the movement of the hand. The improvement of the present invention resides in the provision of a wrist strap extending from the back of the glove toward the forearm. With this invention the glove becomes a part of the player's whole arm, and this gives the player better range and control of the glove.

The present invention provides an apparatus for imparting hand, wrist and arm control to a baseball glove, comprising first means integrally attached to a back wall of the glove so as to extend a distance above and below a lowermost free edge of a front wall of the glove which is sufficient to cover and support at least back portions of a user's hand, wrist and forearm, and second means for securing the first means in position adjacent at least back portions of the user's hand, wrist and forearm. The first and second means operatively cooperate with each other and with the baseball glove to permit flexing of a user's hand and wrist beneath the first means while the first means is disposed sufficiently close to the back of the user's hand, wrist and forearm to support same and impart controlling movements from the user's hand, wrist and forearm to the baseball glove.

Preferably, the first means comprises a support piece and the second means comprises a strap member attached to the support piece and having a length sufficient to wrap around the user's forearm adjacent the wrist and overlap on an outer surface portion of the support piece. The support piece and strap member are desirably fabricated of a bendable but non-stretchable material, such as leather.

It is an object of the present invention to provide a support portion for a baseball glove which covers, supports and operatively cooperates with back portions of the user's hand, wrist and forearm not only to protect the wrist from injury but also to afford the user greater control of the gloved hand during play.

A further object of the invention is to enhance the user's ability to control his/her catching arm and gloved hand by enabling hand, wrist and forearm movements of the player to be imparted to the baseball glove.

The above and other objects, details and advantages of the present invention will become more apparent from the following detailed description of preferred embodiments thereof, when read in conjunction with the accompanying drawings.

BRIEF DESCRIPTION OF THE DRAWINGS

FIG. 1 is a front perspective view of a baseball glove provided with a support portion in accordance with the present invention, the glove being disposed on a user's hand without the strap member being fastened in place.

FIG. 2 is a view of the back of a baseball glove showing a support portion according to the invention having its upper back edge stitched to a lower edge of the back wall of the glove.

DETAILED DESCRIPTION OF PREFERRED EMBODIMENTS

Figure 3:
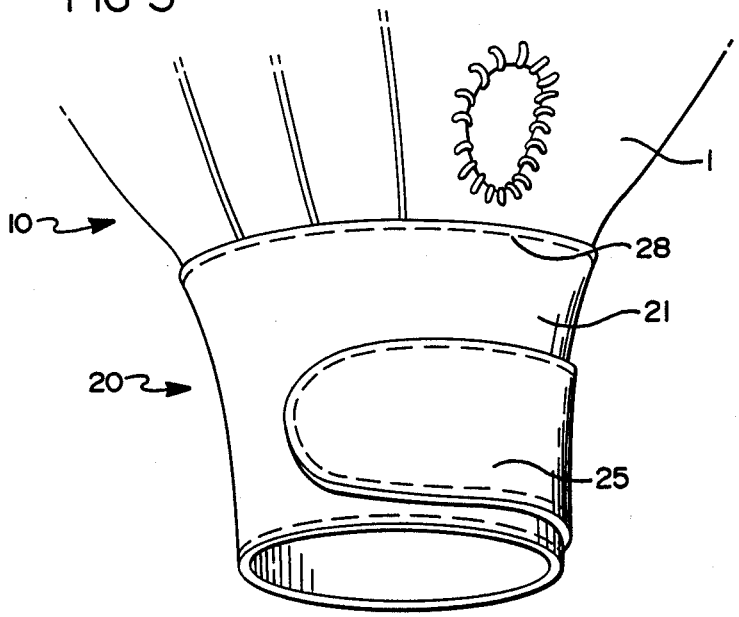
FIG. 3 is a perspective view of the support portion of FIG. 2, showing the details of a preferred fastening means.

With reference to FIGS. 1 and 2, there is shown a baseball glove 10 provided with a support portion 20 in accordance with the invention. The baseball glove 10 is of a conventional construction for a fielder's glove, for example, and includes a back wall 1 (FIG. 2) and a front wall 2 (FIG. 1) joined together to define a fingers portion 3 and a thumb portion 4. The fingers portion 3 and thumb portion 4 are joined together by a bridging portion or pocket 5. Preferably, the baseball glove 10 is fabricated of leather. As shown, glove 10 may also include various stitched portions 6.

As shown in FIG. 1, the glove 10 includes a lower hand-insertion opening 7 defined on the front side by the lower free edge of front wall 2 and on the back side by the downwardly-extending back support piece 21 of support portion 20.

With reference to FIG. 2, the support portion 20 is shown as having the upper section thereof secured to the lower section of back wall 1 of glove 10 by a substantially horizontal line of running stitches 28. Further, a strap 24 is shown as being integrally formed with support piece 21.

Preferably, support piece 21 is fabricated of leather, which will impart the necessary substantially bendable and non-stretchable characteristics thereto. As shown in FIG. 1, the inside surface of support piece 20 may be softly padded.

The support piece 21 extends a distance above and below the lower free end 8 of front wall 2 sufficient to cover and support a lower portion of the back side of the user's hand, the back side of the user's wrist, and an upper portion of the back side of the user's forearm, as will be discussed in greater detail hereinbelow.

The strap 24 may extend integrally from support piece 21, and has a length which is sufficient to permit it to be wrapped around the user's forearm adjacent to and below the wrist area and to overlap a substantial extent on the outer surface of support piece 21, as shown in FIG. 2.

The inner surface of overlapping portion 25 of strap 24 may be provided with a first fastening member which interengages with a second fastening member provided on an outer surface of support piece 21. As best shown in FIG. 3, the first and second fastening members 26, 27 may desirably comprise hook and pile type fastening members such as "Velcro". These fastening members are long enough to permit adjustability in engagement therebetween so that strap 24 may be snugly wrapped around forearms of varying sizes. Other quick-release fastening means may also be used.

In use, the baseball glove 10 is fitted onto the user's hand in a conventional manner, with strap 24 extending freely as shown in FIG. 1. The strap 24 is then wrapped snugly, but comfortably, around the user's forearm adjacent to and below the wrist, and is fastened in overlapping position on support piece 21 as shown in FIG. 2. The construction of strap 24 and fastening members 26, 27 permits convenient one-handed fastening of strap 24 in position.

With the glove and support portion thus operably disposed on the user, it will be understood with reference to FIGS. 1 and 2 that support piece 21 will be securely positioned adjacent back side portions of the user's hand, wrist and forearm. More specifically, support piece 21 will extend along the back of the user's hand and forearm from a lower hand portion above the wrist, along the wrist, and along an upper portion of the user's forearm.

As thus operably disposed, the support piece 21 permits flexing of a user's hand about the wrist while providing firm support against backward bending of the hand at the wrist. Accordingly, the user's wrist will be well supported against backward bending during catching operations. The support piece 21 will also serve to support the user's wrist during forward bending movements.

Also, because support piece 21 extends from a lower hand portion to an upper forearm portion of the user, the support piece 21 provides a unique control and feel for the baseball glove 10. Essentially, support piece 21 will bend with and closely follow the user's hand, wrist and forearm movements during play. The integral attachment of support piece 21 to glove 10 permits these movements to be imparted to glove 10 in a manner which enables glove 10 to become a more integral part of the user's hand, wrist and forearm movements. The unwieldiness often caused by the unnatural weight and bulkiness of glove 10 can thus be substantially overcome as the glove 10 becomes a more natural extension of the user's catching arm.

Various changes could be made in the above constructions without departing from the scope of the invention. It is intended that all matter contained in the above description or shown in the accompanying drawings shall be interpreted as illustrative and not in a limiting sense.

What is claimed is:

1. An apparatus for imparting hand, wrist and arm control to a baseball glove having a front or palm wall and a back wall connected thereto to define a thumb portion, a fingers portion, and a lower hand-insertion opening defined in part by a lowermost free edge of the front wall of the glove, comprising:

a substantially bendable support piece adapted to be integrally attached to the back wall of said baseball glove so as to extend a distance, above and below the lowermost free edge of the front wall of said baseball glove, which is sufficient to cover and support at least back portions of a user's hand, wrist and forearm;

a securing strap member extending from a lower portion of said support piece and adapted to encircle a portion of the user's forearm substantially below the user's wrist so as to secure said support piece in position adjacent at least back portions of the user's hand, wrist and forearm; and said support piece and said securing strap member operatively cooperating with each other and with said baseball glove to permit flexing of a user's hand and wrist beneath said support piece while said support piece is disposed sufficiently close to the back of the user's hand, wrist and forearm to support same and impart controlling movements from the user's hand, wrist and forearm to said baseball glove.

2. An apparatus according to claim 1, wherein:

said securing strap member is adapted to wrap around the user's forearm and overlap on an outer surface portion of said support piece; and means are provided for fastening said overlapping portion of said strap member to said outer surface portion of said support piece.

3. An apparatus according to claim 2, wherein:

said baseball glove, said support piece and said securing member are fabricated of leather; and said fastening means comprises a first fastening member provided on an inner surface of said overlapping portion of said strap member and a second fastening member provided on said outer surface portion of said support piece, said first and second fastening members being interengageable in an adjustable manner.

4. In a baseball glove comprising a front or palm wall having a back wall connected thereto to define a thumb portion, a fingers portion, and a lower hand-insertion opening of said glove, the improvement wherein:

a wrist support portion extends from a lower section of said back wall, said wrist support portion comprising a support piece integrally attached to said back wall so as to extend a distance, above and below a lowermost free edge of said front wall, which is sufficient to cover and support at least back portions of a user's hand, wrist and forearm;

a securing strap member extends from a lower portion of said support piece and is adapted to encircle a portion of the user's forearm substantially below the user's wrist so as to secure said support piece in position adjacent at least back portions of a user's hand, wrist and forearm; and said securing strap member is integrally attached to said support piece and operatively cooperates with said support piece and with said baseball glove to permit flexing of a user's hand and wrist beneath said support piece while said support piece is disposed sufficiently close to the back of the user's hand, wrist and forearm to support same and impart controlling movements from the user's hand, wrist and forearm to said baseball glove.

5. A baseball glove according to claim 4, wherein:

said support piece is fabricated of a substantially bendable and non-stretchable material, such as leather.

6. A baseball glove according to claim 5, wherein:

said strap member extends from a lower side portion of said support piece and is adapted to wrap around the user's forearm and overlap on an outer surface portion of said support piece; and means are provided for fastening said overlapping portion of said strap member to said outer surface portion of said support piece.

7. A baseball glove according to claim 6, wherein:

said fastening means comprises a first fastening member provided on an inner surface of said overlapping portion of said strap member and a second fastening member provided on said outer surface portion of said support piece, said first and second fastening members being interengageable in an adjustable manner.

8. A baseball glove according to claim 7, wherein:

said strap member is fabricated of a substantially bendable and non-stretchable material, such as leather;

an inner surface of said support piece is padded; and said first and second fastening members comprise interengageable hook and pile type members.

9. A baseball glove according to claim 8, wherein:

said baseball glove comprises a fielder's glove.

* * * * *

UNITED STATES PATENT AND TRADEMARK OFFICE

CERTIFICATE OF CORRECTION

PATENT NO. : 4,891,845

DATED : Jan. 9, 1990

INVENTOR(S) : Rufus HAYES

Figure 4:
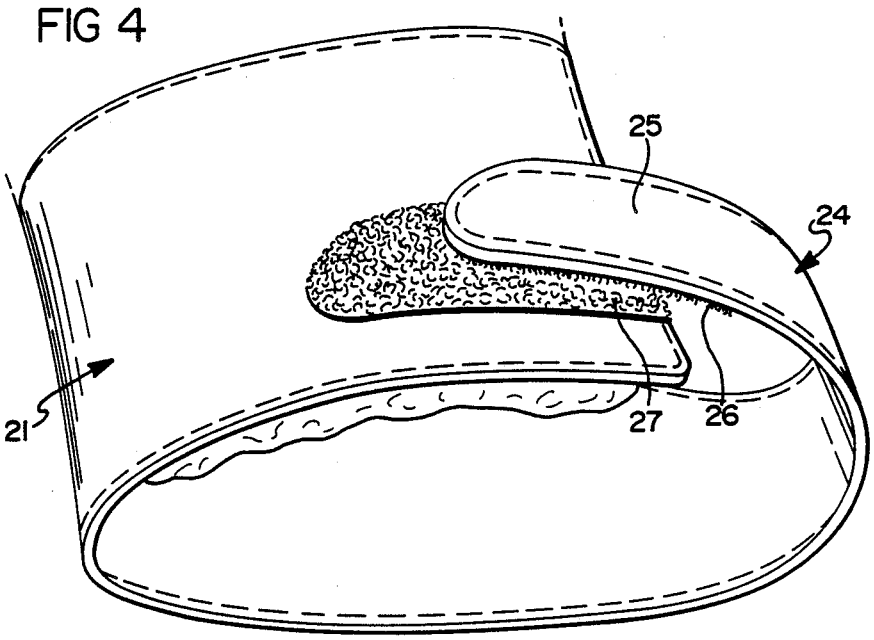

It is certified that error appears in the above-identified patent and that said Letters Patent is hereby corrected as shown below:

IN THE DRAWINGS: Cancel Fig. 2; change "Fig. 3" to --Fig. 2--; and change "Fig. 4" to --Fig. 3--.

Signed and Sealed this

Twenty-fifth Day of June, 1991

*Attest:*

*Attesting Officer*

HARRY F. MANBECK, JR.

*Commissioner of Patents and Trademarks*